US005136950A

United States Patent [19]

Halpin et al.

[11] Patent Number: 5,136,950

[45] Date of Patent: Aug. 11, 1992

[54] FLAME-STABILIZED PYROPHORIC IR DECOY FLARE

[75] Inventors: John L. Halpin; Maurice Verreault; Simon A. Barton, all of Quebec, Canada

[73] Assignee: Her Majesty the Queen in right of Canada, as represented by the Minister of National Defence, Ottawa, Canada

[21] Appl. No.: 660,891

[22] Filed: Feb. 26, 1991

[30] Foreign Application Priority Data

Oct. 10, 1990 [CA] Canada ..... 2027254

[51] Int. Cl.[5] ..... F42B 4/26

[52] U.S. Cl. ..... 102/336; 102/329; 102/343; 102/361; 102/530

[58] Field of Search ..... 102/336, 343, 361, 530, 102/324

[56] References Cited

U.S. PATENT DOCUMENTS 3,613,583 10/1971 Lai et al. ..... 102/37.8
4,739,708 4/1988 Halpin et al. ..... 102/336
4,979,444 12/1990 Schoffl ..... 102/404

*Primary Examiner*—Peter A. Nelson
*Attorney, Agent, or Firm*—Roylance, Abrams, Berdo & Goodman

[57] ABSTRACT

A flare comprising an oxygen reservoir section, a fuel reservoir section and a nozzle section; the oxygen reservoir section having a reservoir capable of containing oxygen at high pressure, and a valve operable by an actuator to selectively permit transmission of pressurized oxygen from the reservoir; the fuel reservoir section including a collapsible fuel bag having a fuel orifice at one end and a plug normally positioned over the orifice; and the nozzle section having a oxygen flow deflector, a fuel atomizing region and an ignition region.

3 Claims, 1 Drawing Sheet

FLAME-STABILIZED PYROPHORIC IR DECOY FLARE

The present invention relates to flares and has particular application to flares that serve as aerial sources of infrared (IR) radiation for decoy purposes.

BRIEF DESCRIPTION OF PRIOR ART

IR decoy flares are used on many military aircraft to protect against attack by heat seeking missiles. Flares which are currently in use are made from a solid pyrotechnic composition of magnesium, TEFLON TM and VITON TM. These are commonly called MTV flares and are ejected from an aircraft and simultaneously ignited by the action of a pyrotechnic squib. The burning MTV emits IR radiation that is essentially a spectral continuum attenuated by atmospheric absorption. It is intended that the falling flare will cause a missile seeker head to turn away from the target aircraft. The MTV flares are quite effective against older type missiles that seek heat in a single IR band.

However modern missiles employ counter-counter measures (CCM). Their more refined seeker heads use two or more spectral bands in an attempt to distinguish between the flare and the aircraft. Both IR and ultraviolet (UV) band may be used. Trajectory discrimination may also be used by some seeker heads and the physical size of the heat source will be become more important in the future as imaging seekers are developed.

Alternatives to MTV flares have therefore been considered in recent years and in particular flares that use the combustion of pyrophoric liquids to generate an intense heat source have been shown to be particularly effective. Pyrophoric flares have the following principal advantages:

a. the IR emission from the flames produced by some pyrophoric liquids is similar to that produced from burning aviation kerosene which is largely a molecular emission of carbon dioxide and water. A continuum component from radiating hot particles can be added in a controlled manner by varying the pyrophoric fuel composition. Thus the IR spectral emission profile can be made to closely match that of a jet aircraft exhaust plume and hot engine metal;

b. the ultra violet radiant intensity from pyrophoric flames is much less than that from MTV flares so that a much closer spectral match is achieved with a jet aircraft exhaust plume;

c. the flame from a pyrophoric flare can be several meters in length and it is therefore much closer in physical size to a jet engine plume than is the MTV flare which is typically less than a meter in length;

d. the trajectory of a launched pyrophoric flare can be varied by altering the aerodynamic properties of the container, whereas the trajectory of an MTV flare is fixed by the properties of the burning surface of the pellet used in the flare;

e. since pyrophoric fuels use air as the oxidant, the fuel may be stored separately from the oxidant MTV flares on the other hand, are comprised of an intimate mixture of oxidant and fuel so that when they are ignited they are very hard to extinguish;

f. under normal conditions, pyrophoric liquids ignite spontaneously when sprayed into air and so no ignition mechanism is required.

In order to effectively protect high-performance jet aircraft from modern missiles, a pyrophoric IR decoy flare must function effectively under the extreme conditions of high airspeed, high altitude, and low temperature. Under normal open burning, the flame from a simple jet of pyrophoric fluid can be blown out when in an air speed above Mach 0.7. This problem was resolved by the invention of a pyrophoric flame anchor as disclosed in Canadian Patent 1,265,988 issued Feb. 20th, 1990 to Her Majesty in Right of Canada as Represented by the Minister of National Defence. This patent teaches that it is possible to effectively operate a flare under the above extreme conditions. There has not been invented as yet an autonomous unit including the flame anchor as disclosed in the above mentioned patent, that functions as an IR decoy flare.

To date, no pyrophoric flare has been commercially produced that can reliably maintain large radiant flames in high-speed air at high altitudes and at low temperatures. As indicated, the pyrophoric flame anchor disclosed in the above patent can overcome the problems of flame stability by the co-ejection of oxygen with the fuel through a spray-generating nozzle. Also, modern plastics and metals can overcome the remaining design problems associated with the required extreme operating conditions and the reactivity of the pyrophoric liquids.

BRIEF SUMMARY OF THE INVENTION

This invention discloses a self-contained flare cartridge having an oxygen reservoir section, a fuel reservoir section and a nozzle section, this latter section being based upon the teachings of the above Canadian patent.

More specifically the flare consists of an oxygen reservoir section, a fuel reservoir section and a nozzle section; the oxygen reservoir section having a reservoir capable of containing oxygen at high pressure, and a valve operable by an actuator to selectively permit transmission of pressurized oxygen from the reservoir; the fuel reservoir section including a collapsible fuel bag having a fuel orifice at one end and a plug normally positioned over the orifice; and the nozzle section having a oxygen flow deflector, a fuel atomizing region and an ignition region.

BRIEF DESCRIPTION OF THE DRAWINGS

The invention will now be described with reference to the attached drawings in which.

DETAILED DESCRIPTION OF THE INVENTION

Figure 1:
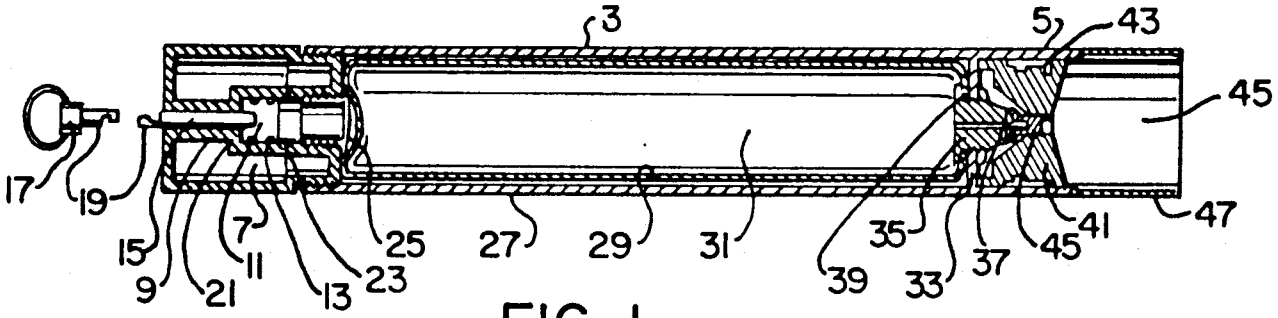
FIG. 1 is a longitudinal cross-sectional view of an embodiment of the pyrophoric IR decoy flare of this invention.

Referring to the drawings and specifically to FIG. 1, the flare consists of an oxygen reservoir section 1, a fuel reservoir section 3, and a nozzle section 5. The oxygen reservoir section 1 includes an oxygen reservoir 7 preferably made from steel and which can hold oxygen at a pressure of up to 1000 pounds per square inch. The oxygen reservoir has a central region 9 which contains a piston valve 11. This valve 11 can be pulled along a cylinder bore 13 by a rod 15 which is releasably secured to an actuator in the form of a pull ring mechanism 17 by a notch and ridge arrangement 19. This arrangement 19 is held together only while it is within the bore 21 which accommodates rod 15. Note that the interlocking arrangement 19 is shown in separated condition in FIG. 1. In the bore 13 there are a number of apertures 23 which are covered when the piston 11 is towards its right hand limit of travel and are uncovered when the piston 11 is towards its left hand limit of travel. A deflector plug 25 covers the right hand end of bore 13.

The fuel reservoir section 3 includes a cylindrical plastic or metal casing 27 which includes a fuel bag 29 preferably made from VITON TM or aluminum and is of a structure which can be compressed by the pressurized oxygen 7. This bag 29 contains pyrophoric fuel 31. An outlet body 35 is secured to one end of the bag 29, the outlet body 35 having a bore 37 through which fuel can pass from the bag 29. A plug 45 of VITON TM or other suitable material is positioned over the end of the bore 37 to retain the pyrophoric fuel within the fuel bag 31 until activation of the flare is required.

The nozzle section 5 consists of a cylindrical extension of the casing 27 and includes an internal annular wall 33. The annular wall 33 accommodates the outlet body 35 and also includes an orifice 39 through which oxygen can pass. A flow deflector 41 is secured downstream of the body 35 and is held in place by tap bolts 43. The plug 45 is accommodated within the deflecter 41. The ignition area of the flare is within a cylindrical extension 47 in nozzle section 5 which forms a sheltered ignition area which helps to stabilize the flame in high speed air and prevents any possible problems of blowout under a high air speed as well as facilitating high altitude ignition.

To operate the flare, piston 11 is displaced towards the left by pulling upon the actuator 17 and this uncovers the apertures 23. Oxygen 7 then passes through apertures 23, moves the oxygen deflector plug 25 towards the right and then passes along the inside of the casing 27 and around the fuel bag 29. The pressure upon the fuel bag 29 from the pressurized oxygen then forces fuel out through bore 37 ejecting the plug 45. Oxygen also continues out through aperture 39 and mixes with the fuel proximate the flow deflector 41. The fuel ignites automatically. The pressurized oxygen then continues to collapse the fuel bag 29 so forcing more fuel through the bore 37 and providing oxygen to the fuel. When VITON TM is used for the material of the fuel bag, it is found to have good chemical resistance to the pyrophoric fuel, however it tends to be quite rigid at temperatures below −20° C. Aluminum is quite acceptable for the material of a fuel bag as it is both chemically resistant to pyrophoric fuel and does not alter appreciably in rigidity at low temperatures. However, it is difficult to completely empty an aluminum fuel bag by the action of high pressure oxygen as it is too rigid to completely collapse. A fluorosilicon can also be used as the material for the fuel bag and although it is slightly less resistance to attack by pyrophoric fuel it is very flexible to at least −60° C. For a limited shelf life item, fluorosilicon would therefore be the preferred material to use.

To achieve rapid mixing of the pyrophoric fuel and the oxygen, the oxygen flow must be ejected as close as possible to the fuel flow and at an angle to the fuel flow so that good atomization is achieved. For good ignition the diameter of the coaxial oxygen flow should be no more than twice the diameter of the fuel orifice.

Figure 2:
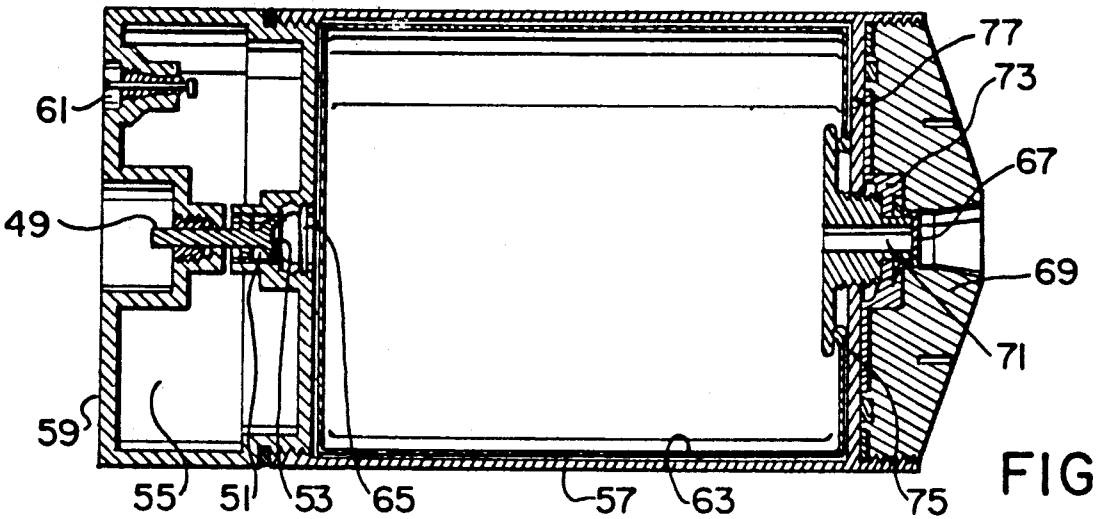
FIG. 2 is a longitudinal cross-sectional view of a second embodiment of the pyrophoric IR decoy flare of this invention.

Referring to FIG. 2, there is shown a flare of the same general construction as that shown in FIG. 1 except that the actuator 49 is pushed into the flare to cause ignition. The actuator 49 has a concave front end 51 which is positioned beside a disc 53 of copper or other suitable material which keeps pressured oxygen 55 from the inside of the fuel reservoir section casing 57.

The oxygen reservoir 59 is charged with pressurized oxygen 55 through a valve 61. In order to prevent any damage occurring to the fuel bag 63, a steel pin 65 is positioned so that the sheared copper disc 53 is prevented from impinging upon the fuel bag. A plug 67 of VITON TM or other suitable material is retained within flow deflector 69 so normally closing the bore 71 from the fuel bag 63. A plate 73 is retained against an annular wall 75 of the fuel reservoir section by plug 67. An oxygen aperture 77 is situated through the wall 75 and is normally closed by a cover 73.

During operation of the flare shown in FIG. 2, the actuator 49 is pushed towards the right, the copper disc 53 is displaced out of its fixed position and pressurized oxygen 55 flows through into the fuel reservoir section casing 57. The outside of the fuel bag 63 is placed under pressure and fuel is forced through bore 71, forcing plug 67 out of its retained position and releasing cover 73 which is also ejected. Pressurized oxygen also flows through aperture 77 and mixes with the fuel which spontaneously ignites. The sheltered area from which the flame propagates is of a minimum size in the embodiment of FIG. 2 but has found to be adequate to achieve effective high speed operation at high altitudes.

The radiant intensity/time profile of the pyrophoric flare depends upon the fuel mass, the oxygen pressure and the fuel and oxygen exit aperture or orifice diameters. These perameters are easily adjustable to obtain the desired profile.

It is thus seen that a unique type of pyrophoric IR decoy flare has been disclosed which effectively operates in high speed air and under the extreme operating conditions of high altitude and low temperatures.

We claim:

1. A flare, comprising: an oxygen reservoir section, a fuel reservoir section and a nozzle section;

the oxygen reservoir section having a reservoir capable of containing oxygen at high pressure, and a valve operable by an actuator to selectively permit transmission of pressurized oxygen from the reservoir;

the fuel reservoir section including a collapsible fuel bag having a fuel orifice at one end, a plug normally positioned over the fuel orifice and a casing within which the fuel bag is situated, one end of the casing being secured to the oxygen reservoir section and the other end having an aperture therein through which the fuel orifice passes and an oxygen orifice, such that when the valve is operated to transmit pressurized oxygen to the fuel reservoir section, the oxygen flows within the casing and around the bag, so collapsing the bag and forcing fuel therefrom, and then through the oxygen orifice to the nozzle section; and the nozzle section having an oxygen flow deflector, a fuel atomizing region and an ignition region.

2. The flare of claim 1, wherein the valve comprises of a cylinder bore opening into the fuel reservoir section, an aperture in the mid region of the bore providing access to the oxygen reservoir, and a piston within the bore and normally covering the aperture, the actuator being secured to the piston for selectively moving the piston to uncover the aperture.

3. The flare of claim 1, wherein the valve comprises of a thin disc closing a passage between the oxygen reservoir and the fuel reservoir section, and the actuator is slidably mounted so that it can be pushed against the disc to displace it and open the passage.

* * * * *